US006428240B1

(12) United States Patent
Ehrlich et al.

(10) Patent No.: US 6,428,240 B1
(45) Date of Patent: Aug. 6, 2002

(54) SECTIONAL INTERLOCKING SANDBAGS

(76) Inventors: Peter D. Ehrlich, 3586 Wesley St., Culver City, CA (US) 90232; Steve A. Slater, 9121 1/2 Airdrome St., Los Angeles, CA (US) 90035

( * ) Notice: Subject to any disclaimer, the term of this patent is extended or adjusted under 35 U.S.C. 154(b) by 0 days.

(21) Appl. No.: 09/776,521

(22) Filed: Feb. 2, 2001

(51) Int. Cl.[7] ..... F02B 7/08

(52) U.S. Cl. ..... 405/114; 405/116; 405/18; 405/16; 383/32

(58) Field of Search ..... 405/115, 114, 405/116, 107, 91, 15, 16, 17, 18, 19, 21, 22, 25, 284, 32

(56) References Cited

U.S. PATENT DOCUMENTS

| | | | | | |
|---|---|---|---|---|---|
| 3,374,635 | A | | 3/1968 | Crandall | |
| 3,396,542 | A | | 8/1968 | Lamberton | |
| 3,474,626 | A | | 10/1969 | Colle | |
| 3,561,219 | A | * | 2/1971 | Nishizawa et al. | 405/19 |
| 3,696,623 | A | | 10/1972 | Heine et al. | |
| 3,886,751 | A | | 6/1975 | Labora | |
| 3,957,098 | A | * | 5/1976 | Hepworth et al. | 405/17 |
| 4,102,137 | A | | 7/1978 | Porraz et al. | |
| 4,135,843 | A | * | 1/1979 | Umemoto et al. | 405/18 |
| 4,184,788 | A | | 1/1980 | Colle | |
| 4,362,433 | A | | 12/1982 | Wagner et al. | |
| 4,449,847 | A | | 5/1984 | Scales et al. | |
| 4,889,446 | A | * | 12/1989 | Holmberg | 405/19 |
| 4,981,392 | A | * | 1/1991 | Taylor | 405/115 |
| 5,669,732 | A | | 9/1997 | Truitt | |
| 5,857,806 | A | * | 1/1999 | Melin | 405/115 |
| 5,971,661 | A | * | 10/1999 | Johnson et al. | 405/114 |
| 6,126,362 | A | * | 10/2000 | Carter et al. | 405/114 |

FOREIGN PATENT DOCUMENTS

| | | | | |
|---|---|---|---|---|
| DE | 3925856 | * | 2/1991 | 405/18 |
| EP | 368107 | * | 10/1989 | |

* cited by examiner

*Primary Examiner*—Heather Shackelford
*Assistant Examiner*—Frederick L. Lagman
(74) *Attorney, Agent, or Firm*—Sanford Astor

(57) ABSTRACT

A length of material, such as woven polyethylene, woven polypropylene, burlap, or other woven material, divided into a series of two or more substantially equal sized sections. Every other section is filled with sand, or other material. When the length of material is put in place, each row alternating a filled section and an unfilled section, a very secure, interlocking, substantially water-tight structure is formed which is much more effective in preventing the flow of water, mud or silt. Because each section is substantially square, the sections can be stacked in a parallel or transverse direction, to effect a wider and stronger structure which is substantially impervious to the flow of water, mud or silt.

22 Claims, 2 Drawing Sheets

SECTIONAL INTERLOCKING SANDBAGS

This invention is described in our Disclosure Document #480337 filed Sep. 26, 2000.

BACKGROUND OF THE INVENTION

Sandbags are commonly used to try to prevent the passage of water, mud and silt during a flood or other water flow problems. Sandbags now in use are difficult to keep stacked, and they do not provide a stable structure when stacked or piled.

Suggestions have been made to provide a method for stacking bags, such as in U.S. Pat. No. 3,374,635 where rounded bags are tied together with lashing. However, as can be clearly seen, there are gaping spaces between the stacked bags, allowing considerable water to pass through the stacked bags.

Another suggested method is shown in U.S. Pat. No. 3,886,751 using complex shaped bags, which have a protuberance which fits into an indentation in an adjoining bag. This method is very inefficient because the protuberances do not maintain their integrity on site. The bags also require steel rods to hold open a second filler protuberance. These fillers can get easily clogged and the bags can get easily misshapen so that they do not fit together.

SUMMARY OF THE INVENTION

Applicants' invention comprises a length of material, such as woven polyethylene, woven polypropylene, burlap or other woven material, divided into a series of two or more substantially equal sized sections. Every other section is filled with sand, or other equivalent material. When the length of material is put in place, each row with an alternating filled section and an unfilled section, and stacked in layers, creates a very secure, substantially water-tight structure, which is much more effective than the prior methods in preventing the flow of water.

Because each section is substantially square, the sections can be stacked in a parallel or transverse direction, to effect a wider and stronger water-tight structure. The sections interlock to attain greater strength and water flow prevention.

OBJECTS OF THE INVENTION

Accordingly, several objects and advantages of the invention are as follows:

It is an object of the present invention to provide a portable, substantially water-tight bag structure to prevent the flow of water, mud and silt in a flood.

Another object of the invention is to provide a substantially water-tight bag structure which is easy to assemble by hand and which is strong, substantially impermeable and secure.

Yet another object of the invention is to provide sandbags which may be interlocked to provide a strong, substantially water-tight structure.

DETAILED DESCRIPTION OF THE INVENTION

Figure 1:
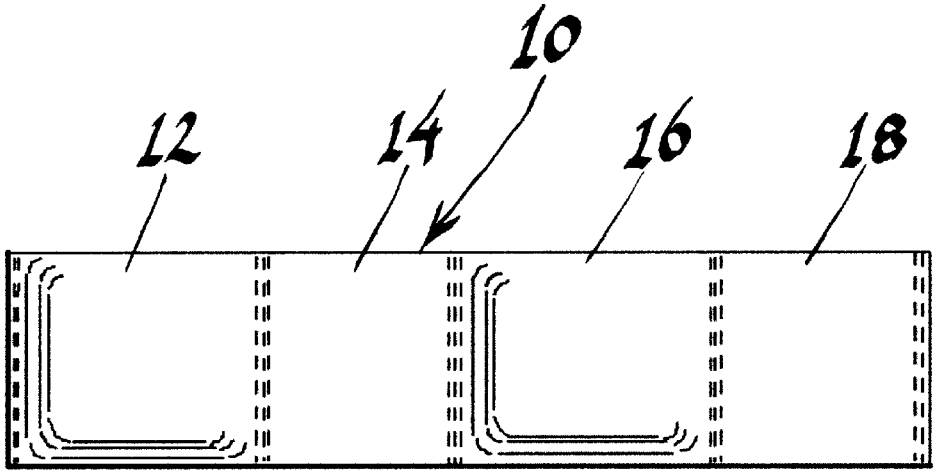
FIG. 1 is a top plan view of the bag structure of this invention.
Figure 2:
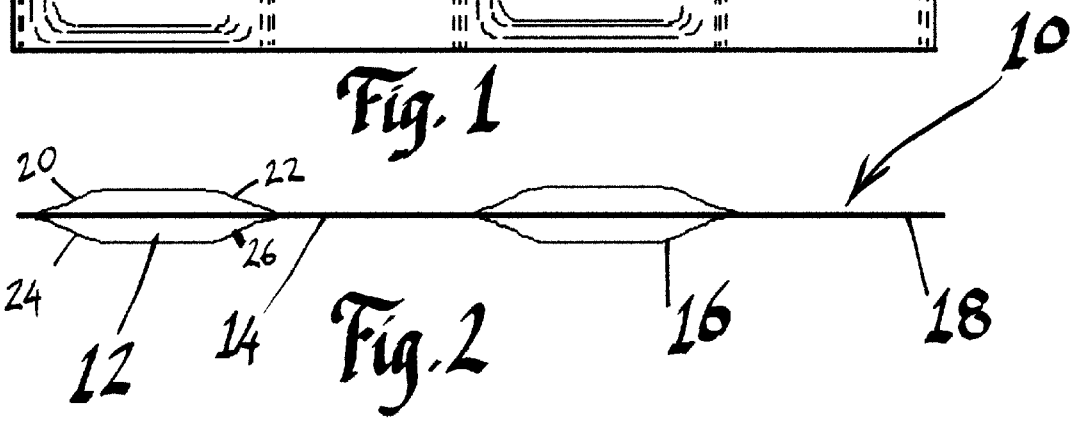
FIG. 2 is a side elevational view.
Figure 3:
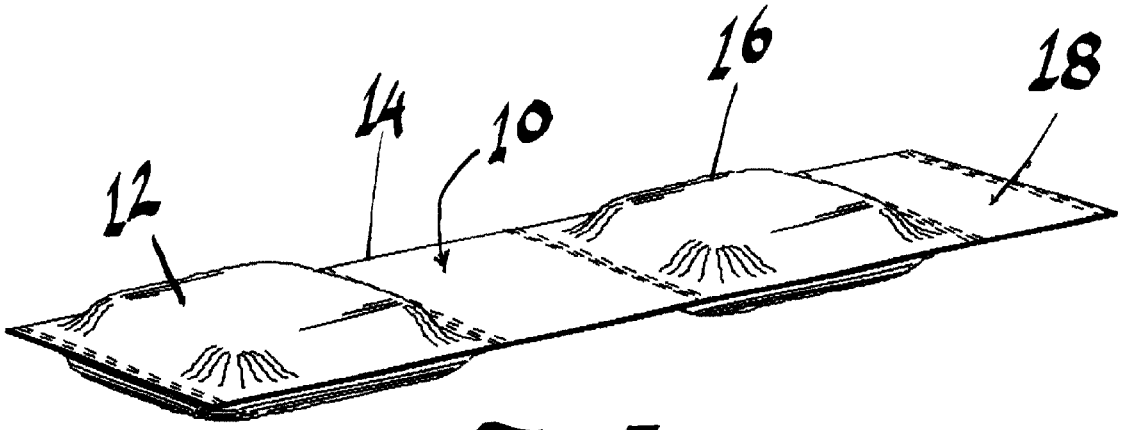
FIG. 3 is a perspective view.

Referring now to the drawings, there is shown in FIGS. 1–5 a length of material 10, such as woven polyethylene, woven polypropylene, burlap, or other woven material, divided into substantially equal-sized, square sections 12, 14, 16 and 18. Sections 12 and 16 are filled, such as with sand, and sections 14 and 18 are unfilled. The sections are divided by any method of sealing the sections apart, such as heat, sewing, clamping, stapling or adhesive.

Figure 4:
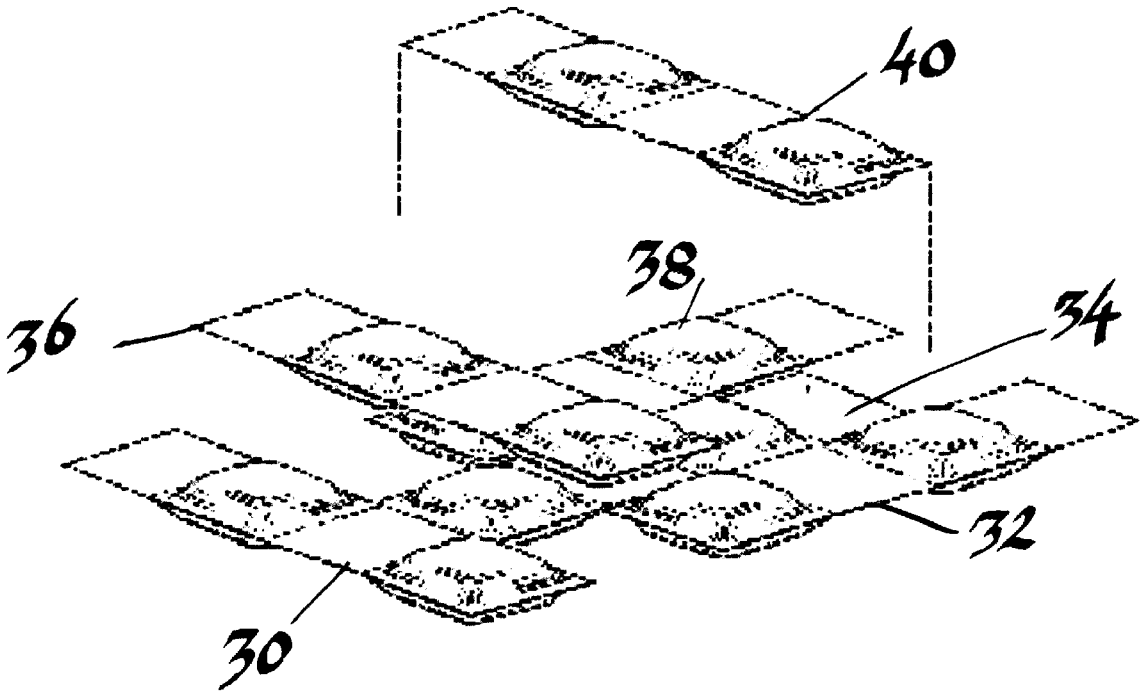
FIG. 4 is a perspective view of the transverse stacking of the bags.
Figure 5:
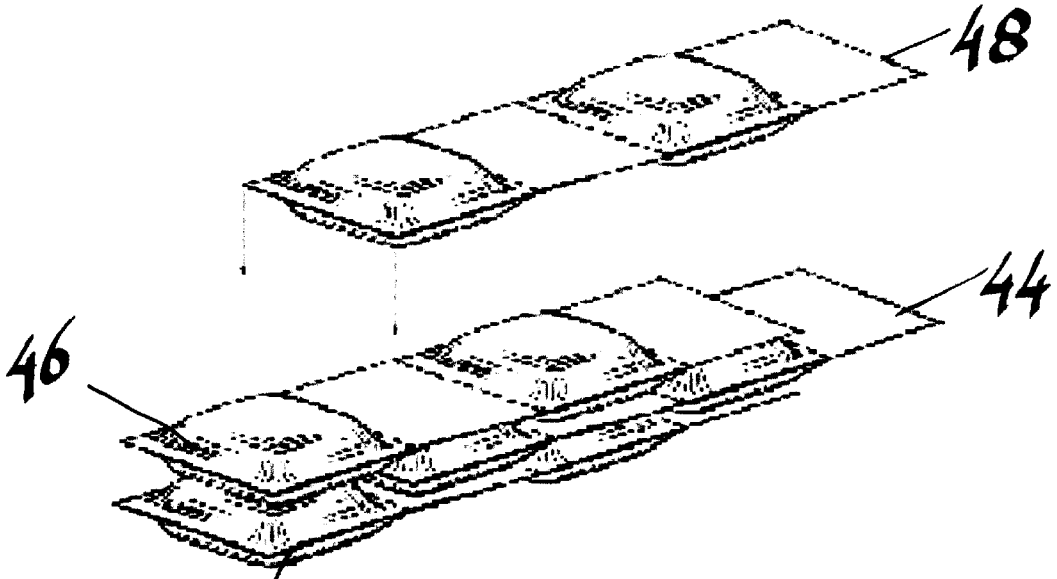
FIG. 5 is a perspective view of the parallel stacking of the bags.

The filled sections, 12 and 16, preferably have slanted sides, 20, 22, 24, and 26. As can be seen in FIGS. 4 and 5, the slanted sides of each filled section will fit together quite tightly, to provide a substantially water-tight structure. The angle of the slanted sides can be from about 30 degrees to about 40 degrees, with 35 degrees being optimal. However, the exact angle is not crucial, because the bags are self-conforming.

FIG. 4 shows several bags, 30, 32, 36, 38 and 40, each having alternating sections of two filled sections and two unfilled sections, in which the bags are stacked in a transverse direction to provide a wide structure when that is desired.

FIG. 5 shows the more traditional stacking of bags 42, 44, 46 and 48 in a parallel direction. As the bags are stacked to create a wall, each filled section is alternately placed upon an unfilled sections and each unfilled section is placed on a filled section. Due to the slanted four corners, 20, 22, 24 and 26 of each filled section, the bags fit tightly together in a web connection, to provide a greater frictional coefficient and hence a stronger assemblage.

The alternating sections of the bags of this invention also provide a convenient way for men to carry the bags to a needed site, as they can be thrown over the shoulder, an unfilled section hanging over the shoulder with two filled sections hanging down. The bags are shown with only two filled sections, since that is the easiest for a man to carry due to weight, however the bags could have more than two sections, depending upon their size and filled weight. The bags could also have a plurality of filled sections if they are to be carried and put in place by a machine lifting device.

Any number of interlocking bags can be stacked, depending upon the size, height and length of the wall desired to be built. Sand is usually used to fill the bags, but other materials, such as concrete, aggregate or particulate matter can be used. The bags can be any size, however for manual use the optimum size of each section is from about one foot square on each side to about 18 inches on each side. A one foot section bag having two sections filled with sand and two unfilled sections, will weigh about 40 pounds. An eighteen inch square bag, having two sections filled with sand and two unfilled sections, will weigh about 65 pounds.

Having thus described the invention,

We claim:

1. A bag adapted to be stacked in layers to prevent the flow of water therethough comprising a length of material having a plurality of substantially square alternating sections, wherein one section is filled with a particulate material and the adjoining section is unfilled.

2. The bag of claim 1 in which the filled sections are filled with sand.

3. The bag of claim 1 in which the material is woven polyethylene, woven polypropylene or burlap.

4. The bag of claim 1 in which each filled section has four slanted sides.

5. The bag of claim 4 in which the sides are slanted at a thirty five degree angle.

6. A bag adapted to be stacked in layers to prevent the flow of water therethough comprising a length of material having a plurality of alternating sections, wherein one section is filled with a particulate material and the adjoining section is unfilled, in which each bag has two filled sections and two unfilled sections.

7. A sandbag adapted to be stacked in layers to prevent the flow of water therethough comprising a length of material having a plurality of substantially square, substantially equal sized, alternating sections, wherein one section is filled with sand and the next adjoining section is unfilled.

8. The bag of claim 7 in which the material is woven polyethylene, woven polypropylene or burlap.

9. The bag of claim 7 in which each filled section has four slanted sides.

10. The bag of claim 9 in which the sides are slanted at an angle of from thirty to forty degrees.

11. A sandbag adapted to be stacked in layers to prevent the flow of water therethough comprising a length of material having alternating sections, wherein one section is filled with sand and the next adjoining section is unfilled, in which each bag has two filled sections and two unfilled sections.

12. A sandbag struture adapted to prevent the flow of water therethough comprising a plurality of sandbags stacked in layers, each sandbag comprising a length of material having a plurality of substantially square alternating sections, wherein one section is filled with sand and the next adjoining section is unfilled, wherein each filled section rests on an unfilled section and each unfilled section rests on a filled section.

13. The sandbag structure of claim 12 in which the material is woven polyethylene, woven polypropylene or burlap.

14. The sandbag structure of claim 12 in which each filled section has four slanted sides.

15. The sandbag structure of claim 14 in which the sides are slanted at an angle of from thirty to forty degrees.

16. The sandbag structure of claim 12 in which the sandbags are stacked in a parallel direction.

17. The sandbag structure of claim 12 in which the sandbags are stacked in both a parallel and a transverse direction.

18. A sandbag struture adapted to prevent the flow of water therethough comprising a plurality of sandbags stacked in layers, each sandbag comprising a length of material having alternating sections, wherein one section is filled with sand and the next adjoining section is unfilled, in which each bag has two filled sections and two unfilled sections.

19. A sandbag struture adapted to prevent the flow of water therethough comprising a plurality of sandbags stacked in successively higher layers, each sandbag comprising a length of material having four alternating sections, two filled with sand and two unfilled, wherein one section is filled with sand and the next adjoining section is unfilled, each filled section having four slanted sides adapted to be interlocked with each successive higher layer.

20. The sandbag structure of claim 19 in which the section sides are slanted at an angle of from thirty to forty degrees.

21. The sandbag structure of claim 19 in which the sandbags are stacked in a parallel direction.

22. The sandbag structure of claim 19 in which the sandbags are stacked in both a parallel and a transverse direction.

* * * * *